US010522955B2

(12) United States Patent
Smith et al.

(10) Patent No.: US 10,522,955 B2
(45) Date of Patent: Dec. 31, 2019

(54) ENHANCED SAFETY SERIAL BUS CONNECTOR

(71) Applicant: MICRO MOTION, INC, Boulder, CO (US)

(72) Inventors: Brian T Smith, Johnstown, CO (US); Atul Vasant Deshpande, Pune (IN); William M Mansfield, Niwot, CO (US); Clayton T. James, Longmont, CO (US); Shaun E Shanahan, Boulder, CO (US)

(73) Assignee: Micro Motion, Inc., Boulder, CO (US)

( * ) Notice: Subject to any disclaimer, the term of this patent is extended or adjusted under 35 U.S.C. 154(b) by 0 days.

(21) Appl. No.: 15/505,424

(22) PCT Filed: Sep. 10, 2014

(86) PCT No.: PCT/US2014/055010
§ 371 (c)(1),
(2) Date: Feb. 21, 2017

(87) PCT Pub. No.: WO2016/039744
PCT Pub. Date: Mar. 17, 2016

(65) Prior Publication Data

US 2017/0244204 A1 Aug. 24, 2017

(51) Int. Cl.
*H01R 24/64* (2011.01)
*H01R 13/6581* (2011.01)
(Continued)

(52) U.S. Cl.
CPC ..... *H01R 24/64* (2013.01); *H01R 13/6581* (2013.01); *H01R 43/18* (2013.01); *H01R 43/20* (2013.01); *H01R 2107/00* (2013.01)

(58) Field of Classification Search
CPC .. H01R 12/724; H01R 13/6581; H01R 24/62; H01R 13/65802; H01R 13/6658;
(Continued)

(56) References Cited

U.S. PATENT DOCUMENTS 4,269,470 A * 5/1981 Ustin ..... H01R 9/2408 439/712
7,497,731 B2 * 3/2009 Rosenfeldt ..... H01R 13/6581 439/607.01
(Continued)

OTHER PUBLICATIONS

"USB 2.0 Specification Engineering Change Notice 9ecn) #1", Oct. 20, 2000 (Oct. 20, 2000), pp. 85-127, XP055190170, Retrieved from the Internet URL:https://www.phoenixcontract.com/assets/downloads_ed/global/web_dwl_technical_info/USB.PDF [retrieved on May 19, 2015] table 6.1 p. 99; figure 6.9.

*Primary Examiner* — Edwin A. Leon
*Assistant Examiner* — Matthew T Dzierzynski
(74) *Attorney, Agent, or Firm* — The Ollila Law Group LLC

(57) ABSTRACT

An enhanced safety serial bus connector (100) is provided. The enhanced safety serial bus connector (100) includes a shell (110) with a first end (110*a*) and a second end (110*b*), the first end (110*a*) being a terminal end of the shell (110) and having a terminal centerline (CL), and the second end (110*b*) being the lead end of the shell (110). The enhanced safety serial bus connector (100) also includes an insulating body (120) disposed inside the shell (110) and extending from approximately the first end (110*a*) to the second end (110*b*) and a plurality of conductors (130) substantially disposed in the insulating body (120) and extending from the first end (110*a*) to the second end (110*b*). The plurality of conductors (130) include contacts (132) that are proximate the first end (110*a*) and have contact centerlines (X, Y) that are substantially parallel to the terminal centerline (CL),
(Continued)

wherein each conductor (130*a*-130*d*) of the plurality of conductors (130) are spaced apart from an adjacent conductor (130*a*-130*d*) with a distance that substantially conforms to spacing requirements of a serial bus standard that defines a voltage on the plurality of conductors (130) and is equal to or greater than a minimum enhanced safety distance requirement for the voltage defined by the serial bus standard.

18 Claims, 10 Drawing Sheets

(51) Int. Cl.
*H01R 43/18* (2006.01)
*H01R 43/20* (2006.01)
*H01R 107/00* (2006.01)

(58) Field of Classification Search
CPC .. H01R 23/6873; H01R 12/57; H01R 12/585; H01R 12/7064; H01R 12/712; H01R 12/714; H01R 12/716; H01R 12/725; H01R 13/24
See application file for complete search history.

(56) References Cited

U.S. PATENT DOCUMENTS

| | | | | |
|---|---|---|---|---|
| 7,717,745 | B2 * | 5/2010 | He | H01R 13/642 439/607.23 |
| 8,376,785 | B2 * | 2/2013 | Lapidot | H01R 13/6461 439/60 |
| 8,801,462 | B2 * | 8/2014 | Tsai | H01R 12/724 439/607.01 |
| 9,065,231 | B2 * | 6/2015 | Cho | H01R 24/62 |
| 9,112,305 | B2 * | 8/2015 | Sato | H01R 13/5219 |
| 9,270,067 | B2 * | 2/2016 | Lin | H01R 31/06 |
| 2007/0012306 | A1 | 5/2007 | Rosenfeldt et al. | |
| 2008/0017405 | A1 * | 1/2008 | Huang | H05K 1/026 174/260 |
| 2009/0061671 | A1 * | 3/2009 | Qin | H01R 12/712 439/188 |
| 2009/0258528 | A1 | 10/2009 | He et al. | |
| 2011/0015974 | A1 | 6/2011 | He | |
| 2013/0059475 | A1 * | 3/2013 | Shi | H01R 12/722 439/626 |
| 2014/0055940 | A1 * | 2/2014 | Chen | H01R 13/6594 361/679.32 |
| 2014/0066741 | A1 * | 3/2014 | Peterson | A61B 5/04085 600/393 |

* cited by examiner

ENHANCED SAFETY SERIAL BUS CONNECTOR

TECHNICAL FIELD

The embodiments described below relate to connectors and, more particularly, to an enhanced safety serial bus connector.

BACKGROUND

Serial bus standards specify requirements for compliant connectors. For example, the Universal Serial Bus (USB) standard requires an interface (the portion of the connector that connects with a mating USB compliant connector) with four conductors and a shell. The USB standard also specifies that the four conductors carry signals that are serial digital communications. The serial digital communications are susceptible to signal integrity issues such as noise, cross talk, degradation due to impedances, or the like. To ensure that the signal integrity issues are minimized, the USB standard also requires that the conductors in the interface meet specified dimensions. However, from the interface to, for example, a circuit board, manufacturers can bend the conductors to meet non-standard specifications (e.g., customer's circuit board layout, chassis design, etc.) as long as the signal integrity requirements in the serial bus standards are met.

To meet the signal integrity requirements, the manufacturers typically bend the conductors in a planar curve to interface with the circuit board. The spacing may vary between the conductors along the lengths of the conductors. For example, in a portion along the conductors that is exposed, the spacing might be wider than the portion that is surrounded by a polymer (e.g., PTFE) insulator. Also, the distances along the surface of the insulator between the conductors, and the conductors and the shell, can vary. These issues can be problematic with respect to safety considerations, such as clearance or creepage distance.

Creepage distance is defined as the distance along the surface of the insulator between each of the conductors. Creepage distance is a concern because creepage distance can be the distance at which a discharge occurs between conductors for a given voltage. Discharges between conductors are undesirable due to safety issues. Although designers of circuit boards regularly specify creepage distance in board layouts, the distance between conductors in standardized serial bus connectors are typically specified to ensure signal integrity. That is, the standardized serial bus connectors are designed to maximize data transmission rates while meeting basic safety standards. As a result, the standard serial bus connectors are not well suited for enhanced safety standards (e.g., IEC 60079-7 (Increased Safety)) that are required in many industrial applications.

FIGS. 1 and 2 show an exemplary standard serial bus connector 10. As shown in FIG. 1, the standard serial bus connector 10 is a USB-A connector that includes conductors 12 that are disposed inside a shell 14. The conductors 12 extending from the standard serial bus connector 10 are arranged in a parallel configuration. Due to the parallel configuration, the smallest creepage distance is between the conductors 12 and the shell 14. As a result, if a discharge occurs, it will likely occur between the conductors 12 and the shell 14. The pin-to-pin spacing in the parallel configuration also does not meet spacing requirements of the enhanced safety standard. Furthermore, when mounted to a PCB, the spacing is further reduced by the PCB annular rings necessary for soldering. FIG. 2 shows an exploded view of the standard serial bus connector 10 that includes an insulating body 16. As can be seen, the spacing between the conductors 12 vary along the lengths of the conductors 12. The conductors 12 are more likely to discharge at the minimum spacing or clearance between the exposed portions of the conductors 12. The minimum creepage distance and clearance are less than those required by the enhanced safety standard. As a result, the spacing between the conductors 12, as well as between the conductors 12 and the shell 14, do not meet the enhanced safety standard requirements.

Designing proprietary connectors that meet the enhanced safety standard requirements is prohibitively expensive. For example, the proprietary design does not just require a new connector design but also corresponding inventory buildup of cables, connectors, or the like, that are able to interface with the proprietary connector. Accordingly, there is a need for an enhanced safety serial bus connector that is able to interface with standard cables or connectors.

SUMMARY

An enhanced safety serial bus connector is provided. The enhanced safety serial bus connector comprises a shell with a first end and a second end, the first end being a terminal end of the shell and having a terminal centerline, and the second end being the lead end of the shell. The enhanced safety serial bus connector further comprises an insulating body disposed inside the shell and extending from approximately the first end to the second end and a plurality of conductors substantially disposed in the insulating body and extending from the first end to the second end, the plurality of conductors having contacts that are proximate the first end, and having contact centerlines that are substantially parallel to the terminal centerline. Each conductor of the plurality of conductors are spaced apart from an adjacent conductor with a distance that substantially conforms to spacing requirements of a serial bus standard that defines a voltage on the plurality of conductors, and is equal to or greater than a minimum enhanced safety distance requirement for the voltage defined by the serial bus standard.

A method of forming an enhanced safety serial bus connector is provided. According to an aspect, the method comprising forming a shell comprised of a first end and a second end; the first end being a terminal end of the shell and having a terminal centerline and the second end being the lead end of the shell. The method further comprises forming a plurality of conductors, wherein each conductor of the plurality of conductors are spaced apart from an adjacent conductor with a distance that substantially conforms to the spacing requirements of a serial bus standard that defines a voltage on the plurality of conductors and is equal to or greater than a minimum enhanced safety distance requirement for the voltage defined by the serial bus standard.

ASPECTS

According to an aspect, an enhanced safety serial bus connector (100) comprises a shell (110) with a first end (110*a*) and a second end (110*b*), the first end (110*a*) being a terminal end of the shell (110) and having a terminal centerline (CL), and the second end (110*b*) being the lead end of the shell (110). The enhanced safety serial bus connector (100) further comprises an insulating body (120) disposed inside the shell (110) and extending from approximately the first end (110*a*) to the second end (110*b*) and a plurality of conductors (130) substantially disposed in the insulating body (120) and extending from the first end (110*a*) to the second end (110*b*), the plurality of conductors (130) having contacts (132) that are proximate the first end (110*a*), and have contact centerlines (X, Y) that are substantially parallel to the terminal centerline (CL). Each conductor (130*a*-130*d*) of the plurality of conductors (130) are spaced apart from an adjacent conductor (130*a*-130*d*) with a distance that substantially conforms to spacing requirements of a serial bus standard that defines a voltage on the plurality of conductors (130), and is equal to or greater than a minimum enhanced safety distance requirement for the voltage defined by the serial bus standard.

Preferably, the contact centerlines (X, Y) are spaced from the terminal centerline (CL) at distances that are greater than corresponding distances defined in the serial bus standard.

Preferably, the plurality of conductors (130) are comprised of conductor widths (WI, WO) that are less than widths defined in the serial bus standard.

Preferably, the plurality of conductors (130) are comprised of four conductors (130*a*-130*d*), the four conductors (130*a*-130*d*) being comprised of two inner conductors (130*a*-130*b*) with inner contact centerlines (X) spaced from the terminal centerline (CL) by approximately 1.15 mm, and two outer conductors (130*c*-130*d*) with outer contact centerlines (Y) spaced from the terminal centerline (CL) by approximately 3.58 mm.

Preferably, the plurality of conductors (130) are comprised of four conductors (130*a*-130*d*), the four conductors (130*a*-130*d*) being comprised of two inner conductors (130*a*-130*b*) with an inner contact width (WI) of approximately 0.60 mm, and two outer conductors (130*c*-130*d*) with an outer contact width (WO) of approximately 0.85 mm.

Preferably, the minimum enhanced safety distance requirement comprises a creepage distance, the creepage distance being a distance along a surface of the insulating body (120).

Preferably, the plurality of conductors (130) are uniformly distributed in a surface of the insulating body (120), and extend from the surface of the insulating body (120) substantially perpendicular to the surface of the insulating body (120).

Preferably, the surface of the insulating body (120) is a lead facing surface (124*a*) and wherein the plurality of conductors (130) are uniformly distributed in the lead facing surface (124*a*).

Preferably, the serial bus standard is a Universal Serial Bus (USB) standard.

According to an aspect, a method of forming an enhanced safety serial bus connector (100) comprises forming a shell (110) comprised of a first end (110*a*) and a second end (110*b*); the first end (110*a*) being a terminal end of the shell (110) and having a terminal centerline (CL) and the second end (110*b*) being the lead end of the shell (110). The method further comprises forming a plurality of conductors (130) wherein each conductor (130*a*-130*d*) of the plurality of conductors (130) are spaced apart from an adjacent conductor (130*a*-130*d*) with a distance that substantially conforms to the spacing requirements of a serial bus standard that defines a voltage on the plurality of conductors (130) and is equal to or greater than a minimum enhanced safety distance requirement for the voltage defined by the serial bus standard.

Preferably, the method further comprises forming at least a portion of an insulating body (120) about at least a portion of the plurality of conductors (130), disposing the at least a portion of the insulating body (120) inside the shell (110) and extending from approximately the first end (110*a*) to the second end (110*b*), positioning the plurality of conductors (130) such that the contacts (132) are proximate the first end (110*a*), and have contact centerlines (X, Y) that are substantially parallel to the terminal centerline (CL).

Preferably, the method of forming the enhanced safety serial bus connector (100) further comprises encapsulating the plurality of conductors (130) with the insulating body (120).

Preferably, the step of encapsulating the plurality of conductors (130) comprises uniformly distributing the plurality of conductors (130) in a surface of the insulating body (120).

Preferably, the step of encapsulating the plurality of conductors (130) comprises extending the plurality of conductors (130) from a surface of the insulating body (120) in a direction that is substantially perpendicular to the surface of the insulating body (120).

Preferably, the step of forming the plurality of conductors (130) comprises forming a flat version of the plurality of conductors (130) and bending the plurality of conductors (130).

Preferably, the step of forming the plurality of conductors (130) comprises forming at least one of the plurality of conductors (130) with a width (WI) that is less than the corresponding width specified in the serial bus standard.

Preferably, the step of forming the plurality of conductors (130) comprises forming at least two of the plurality of conductors (130) having centerlines (X), wherein the distance between the centerlines (X) and the terminal centerline (CL) is greater than the corresponding distance specified in the serial bus standard.

Preferably, the serial bus standard is a Universal Serial Bus (USB) standard.

BRIEF DESCRIPTION OF THE DRAWINGS

The same reference number represents the same element on all drawings. It should be understood that the drawings are not necessarily to scale.

DETAILED DESCRIPTION

FIGS. 3-10 and the following description depict specific examples to teach those skilled in the art how to make and use the best mode of embodiments of an enhanced safety serial bus connector. For the purpose of teaching inventive principles, some conventional aspects have been simplified or omitted. Those skilled in the art will appreciate variations from these examples that fall within the scope of the present description. Those skilled in the art will appreciate that the features described below can be combined in various ways to form multiple variations of the enhanced safety serial bus connector. As a result, the embodiments described below are not limited to the specific examples described below, but only by the claims and their equivalents.

Figure 1:
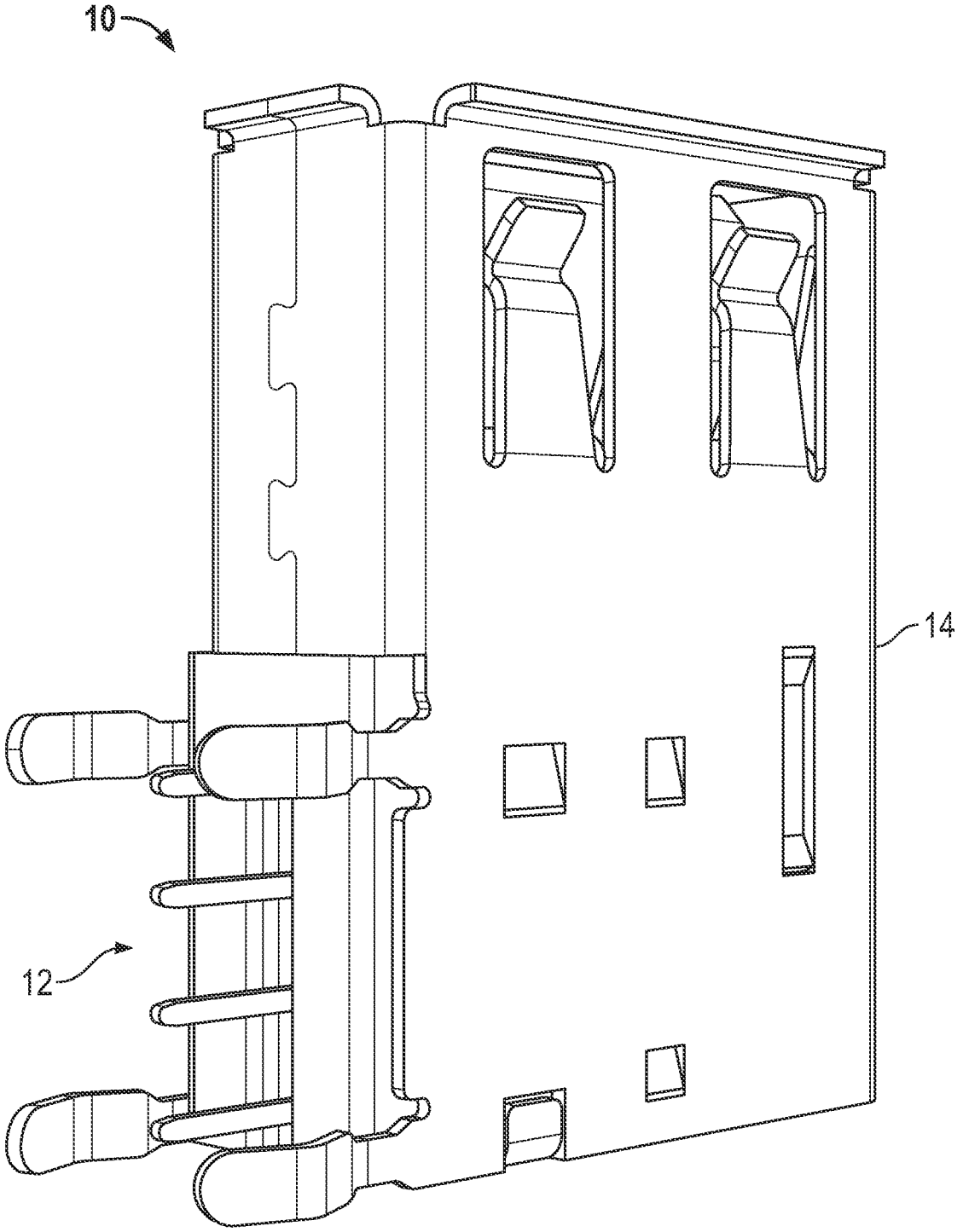
FIG. 1 (Prior Art)
FIGS. 1 and 2 show an exemplary standard serial bus connector 10.
Figure 2:
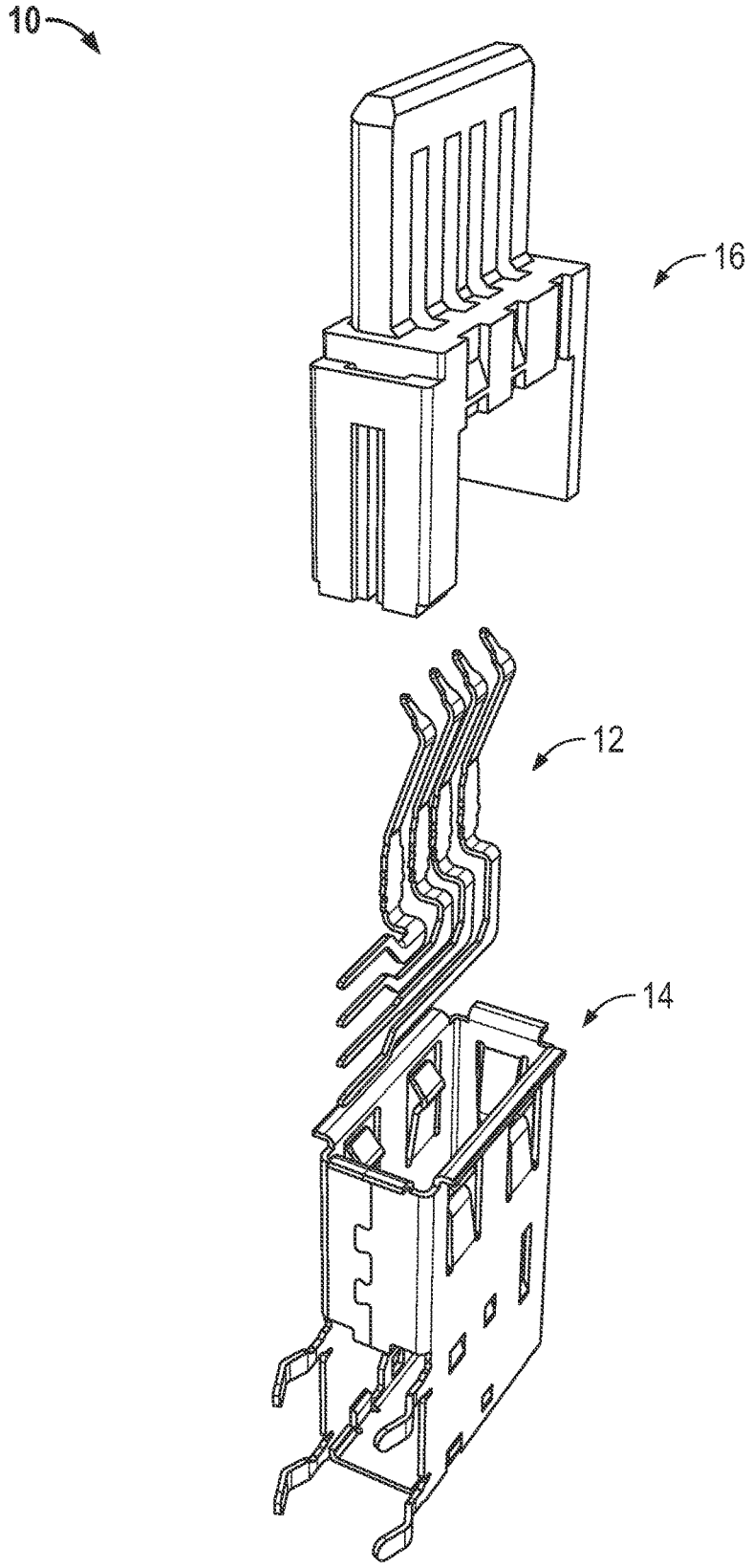
FIG. 2 (Prior Art)
Figure 3:
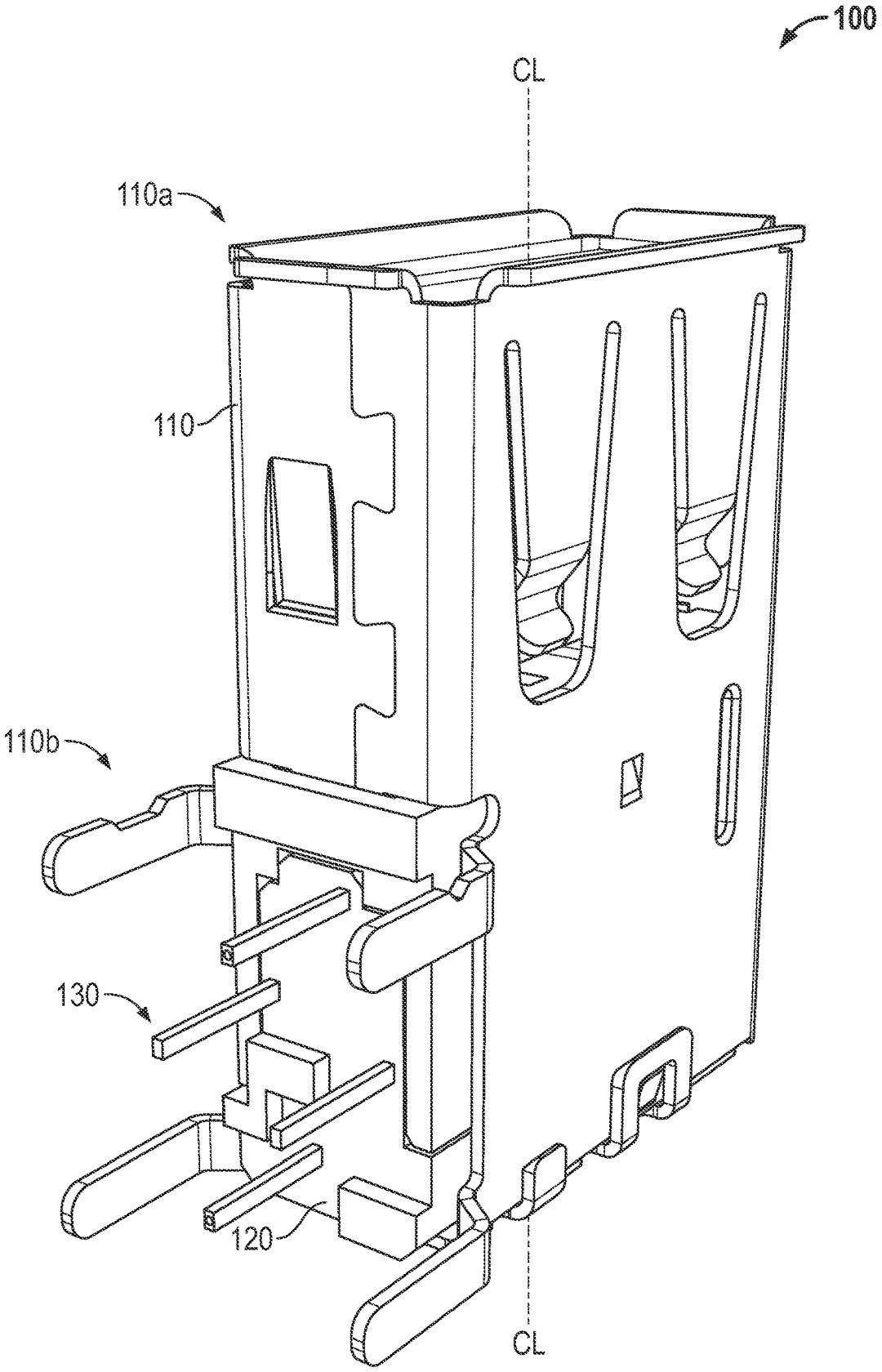
FIG. 3 shows a perspective view of an enhanced safety serial bus connector 100 according to an embodiment.

FIG. 3 shows a perspective view of an enhanced safety serial bus connector 100 according to an embodiment. As shown, the enhanced safety serial bus connector 100 includes a shell 110 with a first end 110*a* and a second end 110*b*. In the embodiment shown, the first end 110*a* is a terminal end of the shell 110 and the second end 110*b* is the lead end of the shell 110. An insulating body 120 is disposed inside the shell 110 and extends from the first end 110*a* to the second end 110*b*. In alternative embodiments, the insulating body may not extend from the first end 110*a* to the second end 110*b*. Additionally or alternatively, the insulating body may be a coating or any other appropriate configuration of insulating material. In the embodiment shown, the enhanced safety serial bus connector 100 also includes a plurality of conductors 130 that are partially disposed in the insulating body 120. The plurality of conductors 130 also extend from the first end 110*a* to the second end 110*b*. As will be explained in the following, the enhanced safety serial bus connector 100 shown in FIG. 3 substantially conforms to the serial bus standard.

The serial bus standard can be one of the USB standards, such as the USB 2.0 and USB 3.0 standards, although alternative embodiments can include other standards. The serial bus standard may include spacing specifications for conductors in a compliant serial bus connector. The serial bus standard may also define the voltage on the conductors. The voltage defined by the serial bus standard can be correlated with a minimum enhanced safety distance by referring to an enhanced safety standard. The enhanced safety standard can be any standard that is not met by the spacing specifications in the serial bus standard. For example, the standard serial bus connectors that are compliant with the USB serial bus standard do not meet the IEC 60079-7 standard for minimum enhanced safety distance requirement. For conductors carrying five volts, the enhanced safety standard may require a creepage distance of 1.60 mm or more. The standard serial bus connector 10, therefore, complies with the serial bus standard, but does not comply with the enhanced safety standard.

The enhanced safety serial bus connector 100 does not comply with the spacing specifications defined by the serial bus standard. Instead, the spacing between each of the plurality of conductors 130, as well as between the plurality of conductors 130 and the shell 110, are equal to or greater than the minimum enhanced safety distance. For example, the spacing between each of the plurality of conductors 130 may be about 1.6 mm, which meets the enhanced safety standard and is greater than the spacing in the USB standard serial bus connector of 1.00 mm. The enhanced safety serial bus connector 100 may nevertheless meet other requirements of the serial bus standard, such as compatibility with mating connectors, transmission rates, signal integrity, electromagnetic compatibility (EMC) requirements, or the like. Accordingly, the enhanced safety serial bus connector 100 may substantially conform to the serial bus standard while still complying with the minimum enhanced safety distance requirement for the voltage defined by the serial bus standard, as will be described in more detail in the following.

Figure 4:
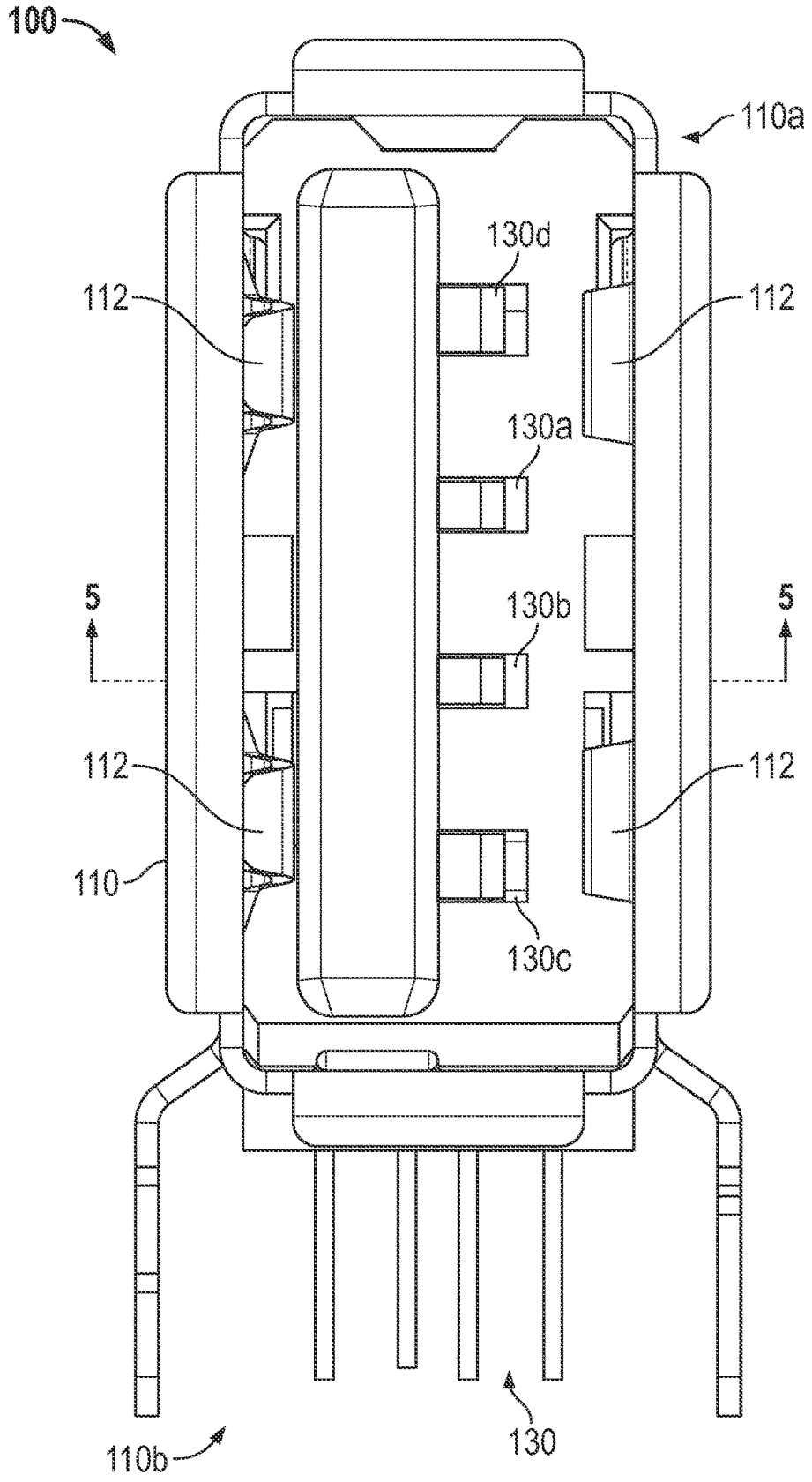
FIG. 4 shows a plan view of the enhanced safety serial bus connector 100.

FIG. 4 shows a plan view of the enhanced safety serial bus connector 100. The interface end of the enhanced safety serial bus connector 100 is depicted. The enhanced safety serial bus connector 100 is shown as including the shell 110 with the first end 110*a* and the second end 110*b* in a USB-A style configuration. Also shown are the insulating body 120 and the plurality of conductors 130. The plurality of conductors 130 is comprised of a first conductor 130*a*, a second conductor 130*b*, a third conductor 130*c*, and a fourth conductor 130*d*. Although four conductors 130*a*-130*d* are shown, more or fewer conductors may be employed in alternative embodiments. In the embodiment of FIG. 4, the four conductors 130*a*-130*d* are arranged at the first end 110*a* in a substantially planar configuration with inner conductors 130*a*, 130*b* and outer conductors 130*c*, 130*d*.

The shell 110 also includes coupling tabs 112. Although not shown in FIG. 4, a USB standard male plug can be inserted into the shell 110 at the first end 110*a* and pressed against the coupling tabs 112. The coupling tabs 112 are configured to press against the USB standard male plug to electrically couple the shell 110 to a shell on the USB standard male plug. The coupling tabs 112 may also mechanically couple and retain the USB standard male plug in the shell 110. In addition, the plurality of conductors 130 can interface with corresponding conductors in the USB standard male plug. Accordingly, the enhanced safety serial bus connector 100 may meet transmission rates, signal integrity, EMC requirements, and other specifications in the serial bus standard. However, the plurality of conductors 130 are also spaced apart with a distance that is equal to or greater than the minimum enhanced safety distance requirement for the voltage defined by the serial bus standard, as will be explained in more detail in the following.

Figure 5:
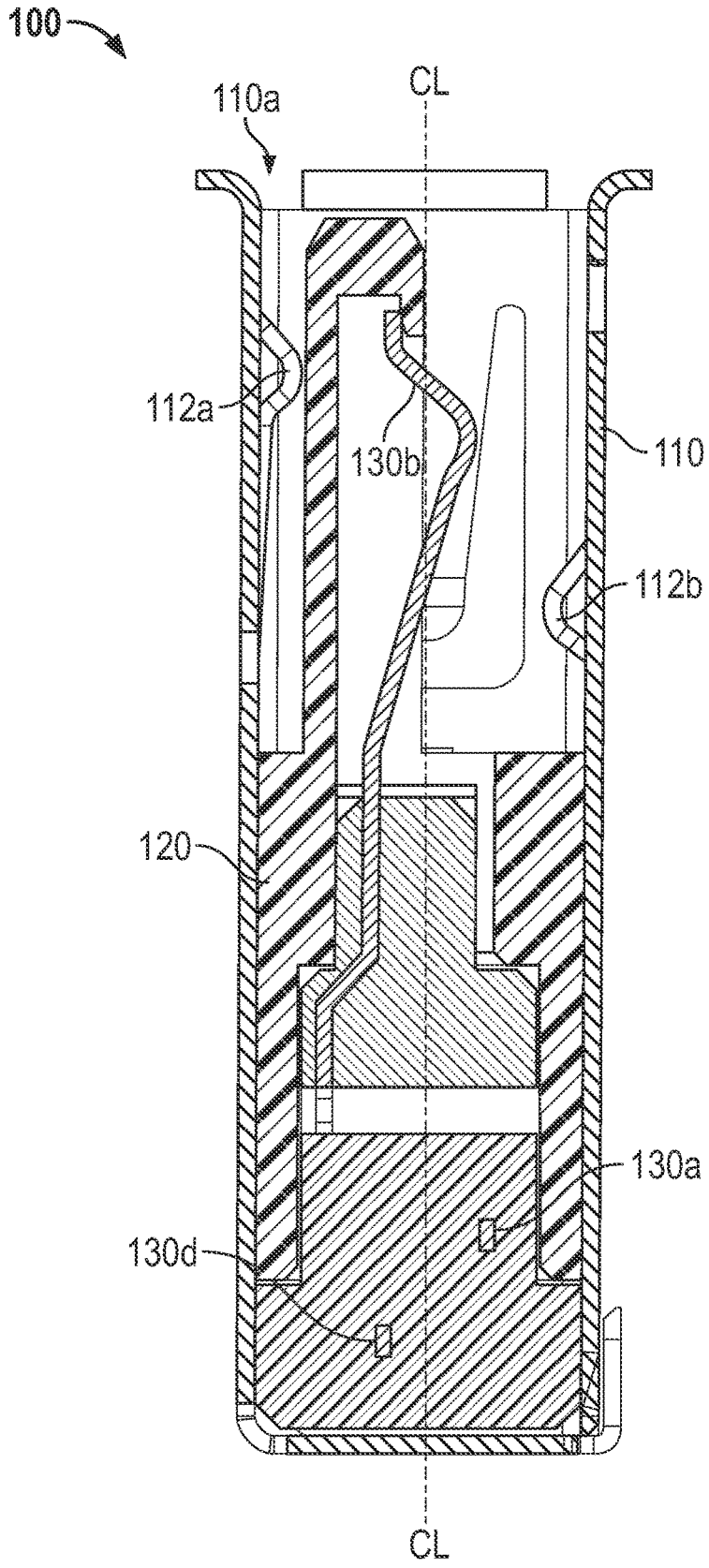
FIG. 5 shows a sectional view of the enhanced safety serial bus connector 100 taken at section 5-5 shown in FIG. 4.

FIG. 5 shows a sectional view of the enhanced safety serial bus connector 100 taken at section 5-5 shown in FIG. 4. The enhanced safety serial bus connector 100 includes the shell 110 with the first end 110*a* discussed in the foregoing. Due to the sectioning, the second end 110*b* is not shown. The shell 110 is also shown with the terminal centerline CL and the coupling tabs 112 described in the foregoing. The insulating body 120 is disposed in the shell 110 and surrounds the second conductor 130*b*. As can be seen in FIG. 5, the shell 110, the insulating body 120, and the second conductor 130*b* are cross-sectioned.

As can be appreciated from FIG. 5, the plurality of conductors 130 are in a coplanar curve at the interface end of the enhanced safety serial bus connector 100. As can also be appreciated, the plurality of conductors 130 bend from the coplanar curve to a distributed configuration in the insulating body 120. More particularly, the first conductor 130*a*, the second conductor 130*b*, and the fourth conductor 130*d* are uniformly distributed in the insulating body 120. The third conductor 130*c* is not shown due to the sectioning, but is also uniformly distributed. The uniform distribution can ensure that the spacing between each of the plurality of conductors 130 is equal to or greater than the minimum enhanced safety distance requirement for the voltage defined by the serial bus standard.

Figure 6:
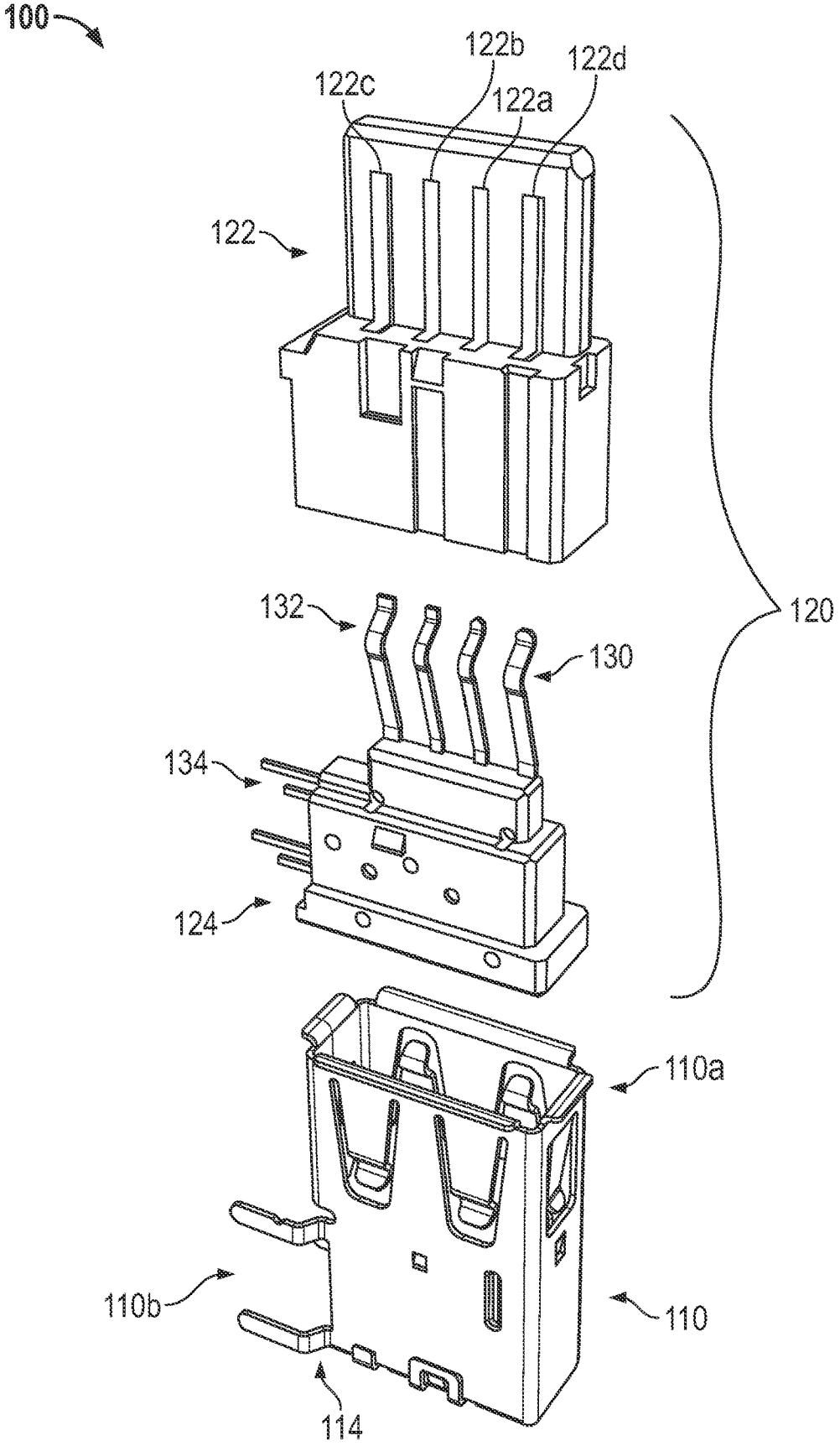
FIG. 6 shows an exploded perspective view of the enhanced safety serial bus connector 100.

FIG. 6 shows an exploded perspective view of the enhanced safety serial bus connector 100. The enhanced safety serial bus connector 100 with the shell 110, the insulating body 120, and the plurality of conductors 130 is discussed in the foregoing. The insulating body 120 and the plurality of conductors 130 are shown as disposed away from the shell 110 for clarity.

The shell 110 includes the first end 110*a* and the second end 110*b* as well as ground posts 114. The ground posts 114 can be adapted to interface and be soldered with, for example, ground traces in a circuit board. Alternative embodiments can include tabs, ridges, or other means of coupling the shell 110 to the board or other components. The shell 110 may provide grounding for the enhanced safety serial bus connector 100. For example, the shell 110 may be comprised of a conductor, such as a tin-coated copper, that ensures the signals carried by the plurality of conductors 130 are not distorted, coupled to noise sources, or the like. The spacing between each of the plurality of conductors 130, as well as the spacing between the plurality of conductors 130 and the shell 110, may be determined by the insulating body 120.

The insulating body 120 is shown as being comprised of a terminal portion 122 and a lead portion 124. The terminal portion 122 is shown as disposed away from the lead portion 124 for clarity. The terminal portion 122 is adapted to couple to the lead portion 124. The terminal portion 122 is also shown as including a first contact groove 122*a*, a second contact groove 122*b*, a third contact groove 122*c*, and a fourth contact groove 122*d*. The contact grooves 122*a*-122*d* can have dimensions that ensure that the spacing between each of the plurality of conductors 130 is equal to or greater than the minimum enhanced safety distance requirement. The insulating body 120 can also mechanically support the plurality of conductors 130.

The plurality of conductors 130 includes contacts 132 and leads 134. The contacts 132 are adapted to electrically couple to corresponding contacts in the USB standard male connector described in the foregoing. The each of the plurality of conductors 130 are adapted to fit within the contact grooves 122*a*-122*d* when the enhanced safety serial bus connector 100 is assembled. The dimensions of the contact grooves 122*a*-122*d* can be selected such that the contacts 132 are pressed against the corresponding contacts in the USB standard male plug with a desired force. Selecting the desired force may include considerations of the pressure that allows a desired transmission rate, which may be a transmission rate specified by the serial bus standard, for the dimensions of the contacts 132. The dimensions of the plurality of conductors 130 can be determined when the plurality of conductors 130 are formed prior to being encapsulated by the insulating body 120, as will be described in the following with reference to FIGS. 7 and 8.

Figure 7:
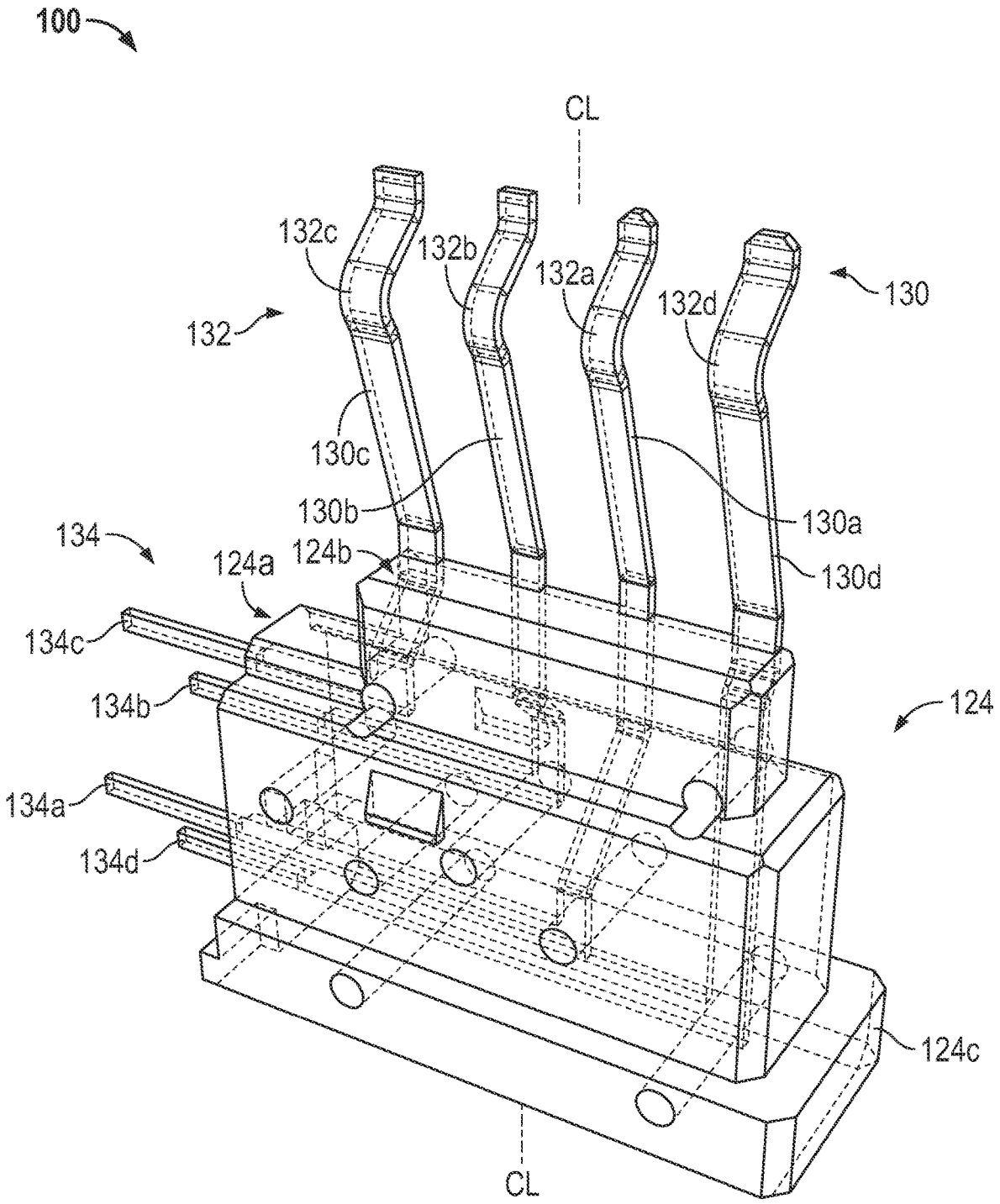
FIG. 7 shows the lead portion 124 encapsulating the plurality of conductors 130.

FIG. 7 shows the lead portion 124 encapsulating the plurality of conductors 130. The lead portion 124 is shown with a lead facing surface 124*a*. As can be seen, the plurality of conductors 130 extending from the lead facing surface 124*a* are substantially perpendicular to the lead facing surface 124*a*. Each of the plurality of conductors 130, which are shown as the first through the fourth conductors 130*a*-130*d*, include the contacts 132. In the embodiment shown, the contacts 132 comprise the first through the fourth contacts 132*a*-132*d*. The lead portion 124 also includes an interface facing surface 124*b* that is adapted to interface with the terminal portion 122 of the insulating body 120. An end plate 124*c* is shown as formed integrally in the interface facing surface 124*b*.

The leads 134 extend from the interface facing surface 124*b* in a direction that is substantially perpendicular to the interface facing surface 124*b*. As can also be seen, the leads 134 are oriented in a direction perpendicular to the contacts 132. For example, the contacts 132 extend parallel to the terminal centerline CL. The leads 134 extend perpendicular to the terminal centerline CL. As can also be seen, the leads 134 are uniformly distributed within the lead facing surface 124*a* of the insulating body 120. That is, in contrast to the parallel arrangement of the conductors 12 in the prior art, the plurality of conductors 130 are uniformly distributed within the lead facing surface 124*a*. The uniform distribution of the plurality of conductors 130 can ensure that the distances between each of the plurality of conductors 130, as well as between the plurality of conductors 130 and the shell 110, is equal to or greater than a minimum enhanced safety distance requirement for the voltage defined by the serial bus standard. For example, the distances between each of the leads 134 can be determined by the spacing between annular rings on a circuit board such that the creepage distance between the annular rings is equal to or greater than the minimum enhanced safety distance requirement. As can be appreciated, the distances between each of the plurality of conductors 130 can be determined when the plurality of conductors 130 are formed.

Figure 8:
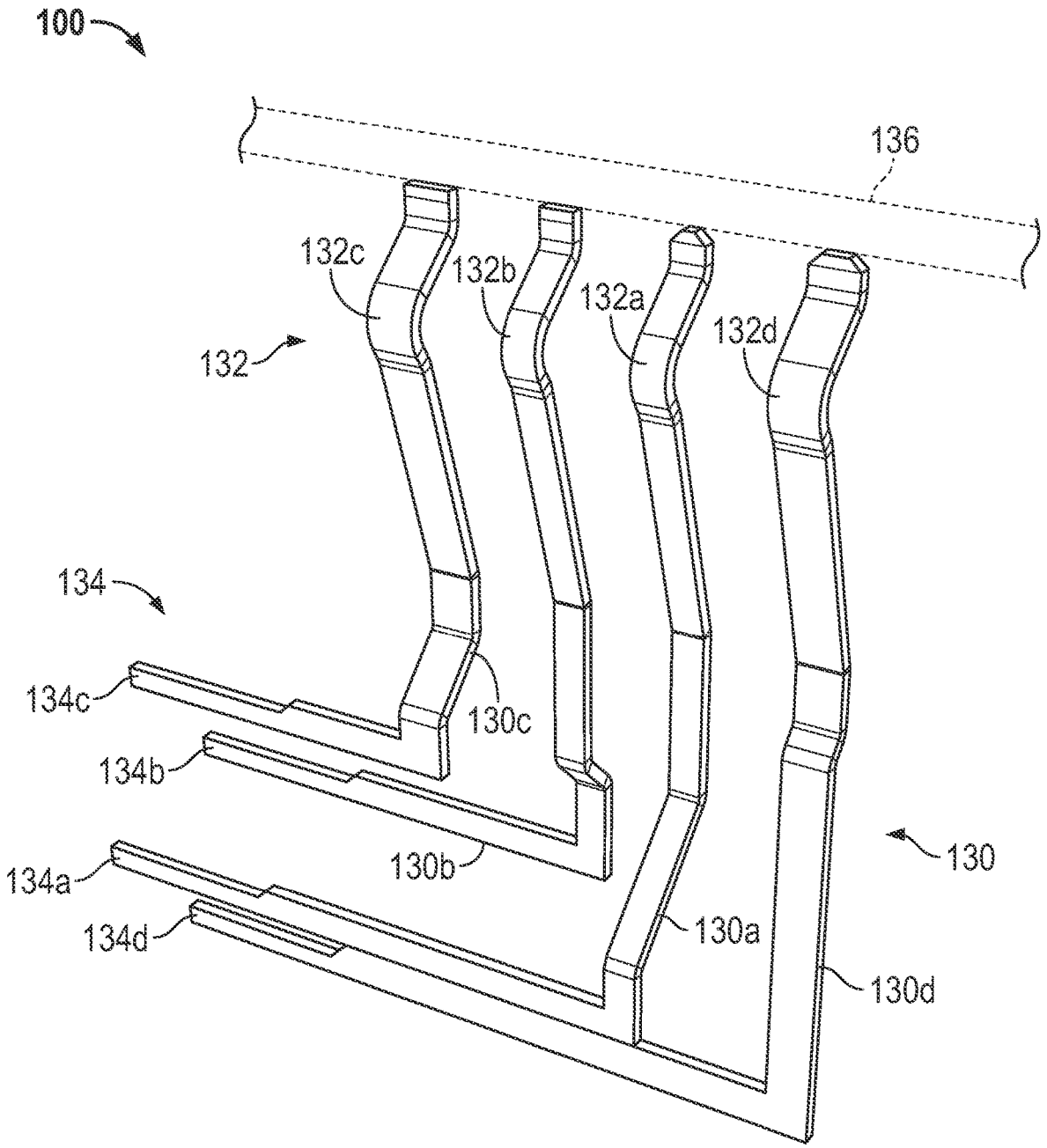
FIG. 8 shows the plurality of conductors 130 without the insulating body 120.

FIG. 8 shows the plurality of conductors 130 without the insulating body 120. The plurality of conductors 130 include the first through fourth conductors 130*a*-130*d*. Also shown are the contacts 132, which include the first through fourth contacts 132*a*-132*d*. The plurality of conductors 130 are also shown with the leads 134, which includes the first through fourth leads 134*a*-134*d*. The contacts 132 are shown as coupled to an assembly strip 136. The assembly strip 136 is shown in phantom lines to illustrate that the assembly strip 136 may be discarded after the plurality of conductors 130 are formed.

As can be seen, each of the plurality of conductors 130 are spaced from an adjacent conductor 130*a*-130*d*. The spacing between each of the plurality of conductors 130 may substantially conform to spacing requirements of the serial bus standard, which can define the voltage on the plurality of conductors 130. The spacing between each of the plurality of conductors 130 can also be equal to or greater than the minimum enhanced safety distance requirement for the voltage defined by the serial bus standard. For example, the spacing between each of the plurality of conductors 130 may be 1.6 mm, which meets the enhanced safety standard and is greater than the spacing in the USB standard serial bus connector of 1.00 mm. As can be appreciated, the spacing between each of the plurality of conductors 130 can be determined when the plurality of conductors 130 are formed, which can include the spacing between each of the plurality of conductors 130 at the interface of the enhanced safety serial bus connector 100.

Figure 9:
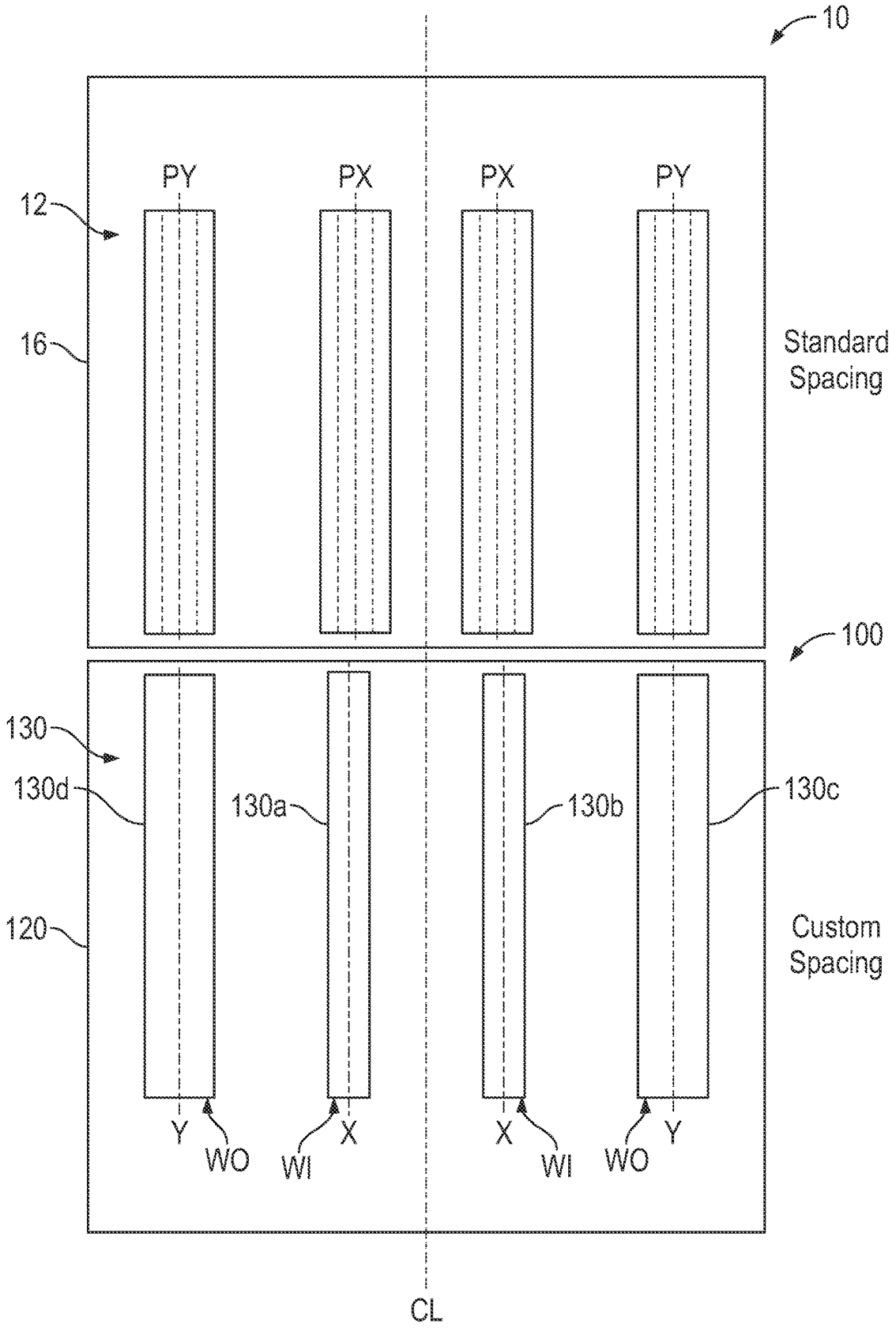
FIG. 9 shows a block diagram of the interface of the enhanced safety serial bus connector 100 and the standard serial bus connector 10 to compare the spacing at the interface.

FIG. 9 shows a block diagram of the interface of the enhanced safety serial bus connector 100 and the standard serial bus connector 10 to compare the spacing at the interface. The enhanced safety serial bus connector 100 is shown as coaxially aligned with the standard serial bus connector 10. The terminal centerline CL extends from the enhanced safety serial bus connector 100 and over the standard serial bus connector 10. The conductors 12 in the standard serial bus connector 10 are shown as having inner contact centerlines PX and outer contact centerlines PY. As can be appreciated, the conductors 12 have the same width, which may be 1.00 mm.

As shown in FIG. 9, the plurality of conductors 130 in the enhanced safety serial bus connector 100 include the four conductors 130*a*-130*d*. The plurality of conductors 130 include inner conductors 130*a*-130*b* with inner contact centerlines X. The plurality of conductors 130 also include outer conductors 130*c*-130*d* with outer contact centerlines Y. It can be seen that the inner contact centerlines X in the enhanced safety serial bus connector 100 are further away from the terminal centerline CL than the prior art inner contact centerlines PX. In addition, the inner conductors 130*a*-130*b* have an inner contact width WI that is smaller than the outer contact width WO.

As can also be seen by comparing the standard serial bus connector 10 and the enhanced safety serial bus connector 100, although the inner contact width WI may not be in compliance with the serial bus standard, the inner two of the conductors 12 of the standard serial bus connector 10 and the inner conductors 130*a*-130*b* of the enhanced safety serial bus connector 100 have some overlapping surfaces. As a result, the plurality of conductors 130 can interface with corresponding conductors in a USB standard male interface. Accordingly, the enhanced safety serial bus connector 100 can substantially conform to the spacing requirements of the serial bus standard.

Although the outer conductors 130*c*-130*d* are shown as having the same width and displaced from the centerline CL by approximately the same distance, outer conductors in alternative embodiments may have different widths and be spaced differently than the outer two of the conductors 12. In the embodiment shown, the widths of the conductors 12 in the standard serial bus connectors 10 may be 1.00 mm wide. The outer conductors 130*c*-130*d* in the enhanced safety serial bus connector 100 can also be about 1.00 mm. However, the inner conductors 130*a*-130*b* can be 0.60 mm wide, which is less than the width of the inner two of the conductors 12. In some embodiments, the outer conductors 130*c*-130*d* can be 0.85 mm wide. As a result, the spacing between the plurality of conductors 130 may be equal to or greater than the minimum enhanced safety distance requirement for the voltage defined by the serial bus standard.

For example, in the embodiment shown, the serial bus standard may require voltages on the plurality of conductors 130 to be five volts. An enhanced safety standard for the five volts on the conductors may require that the creepage distance between each of the plurality of conductors 130 be equal to or greater than about 1.60 mm. The different distances of the contact centerlines X, Y in the enhanced safety serial bus connector 100 and the contact centerlines PX, PY in the standard serial bus connector 10, as well as the difference between the widths of the conductors 12 in the standard serial bus connector 10 and the widths WI, WO of the plurality of conductors 130, can allow the spacing between each of the enhanced safety serial bus connector 100 to be equal to or greater than the minimum enhanced safety distance requirement for the voltage defined by the serial bus standard.

In addition, the distances between the terminal centerline CL and the contact centerlines X, Y may not be within the range specified by the serial bus standard that defines a voltage on the plurality of conductors 130. For example, the distance of the prior art inner contact centerline PX of the inner two of the conductors 12 from the terminal centerline CL in the standard serial bus connector 10 may be explicitly limited to 1.00±0.05 mm (0.95 to 1.05 mm). The distance of the inner contact centerline X of the inner conductors 130*a*-130*b* in the enhanced safety serial bus connector 100 may be specified 1.15±0.05 mm (1.10 to 1.20 mm). Similarly, the widths of each of the plurality of conductors 130 may not be within the range specified by the serial bus standard. For example, the inner conductors 130*a*-130*b* may be specified at 0.60 mm±0.05 (0.55 mm to 0.65 mm). The outer conductors 130*c*-130*d* can have widths of 0.85 mm±0.05 (0.80 mm to 0.90 mm). The serial bus standard may require that the widths of the conductors 12 be 1.00 mm±0.05 (0.95 mm to 1.05 mm). Accordingly, the distances between the terminal centerline CL and the contact centerlines X, Y, as well as the widths WI, WO of each of the plurality of conductors 130, may not be within the ranges specified by the serial bus standard.

Although the dimensions of the plurality of conductors 130 may not be within the ranges specified by the serial bus standard, the enhanced safety serial bus connector 100 can substantially conform to spacing requirements of the serial bus standard that defines the voltage on the plurality of conductors 130. For example, even though the dimensions of the plurality of conductors 130 may not be the same as the conductors 12, the contacts 132 may nevertheless couple to the USB standard male plug. As a result, the enhanced safety serial bus connector 100 can meet the enhanced safety distance requirement while still substantially complying with the serial bus standard. For example, the enhanced safety serial bus connector 100 may substantially conform to the serial bus standard by allowing the data to transmit between, for example, the USB standard male connector and the enhanced safety serial bus connector 100. With the interface of the enhanced safety serial bus connector 100 described, we now turn to the lead portion of the enhanced safety serial bus connector 100.

Figure 10:
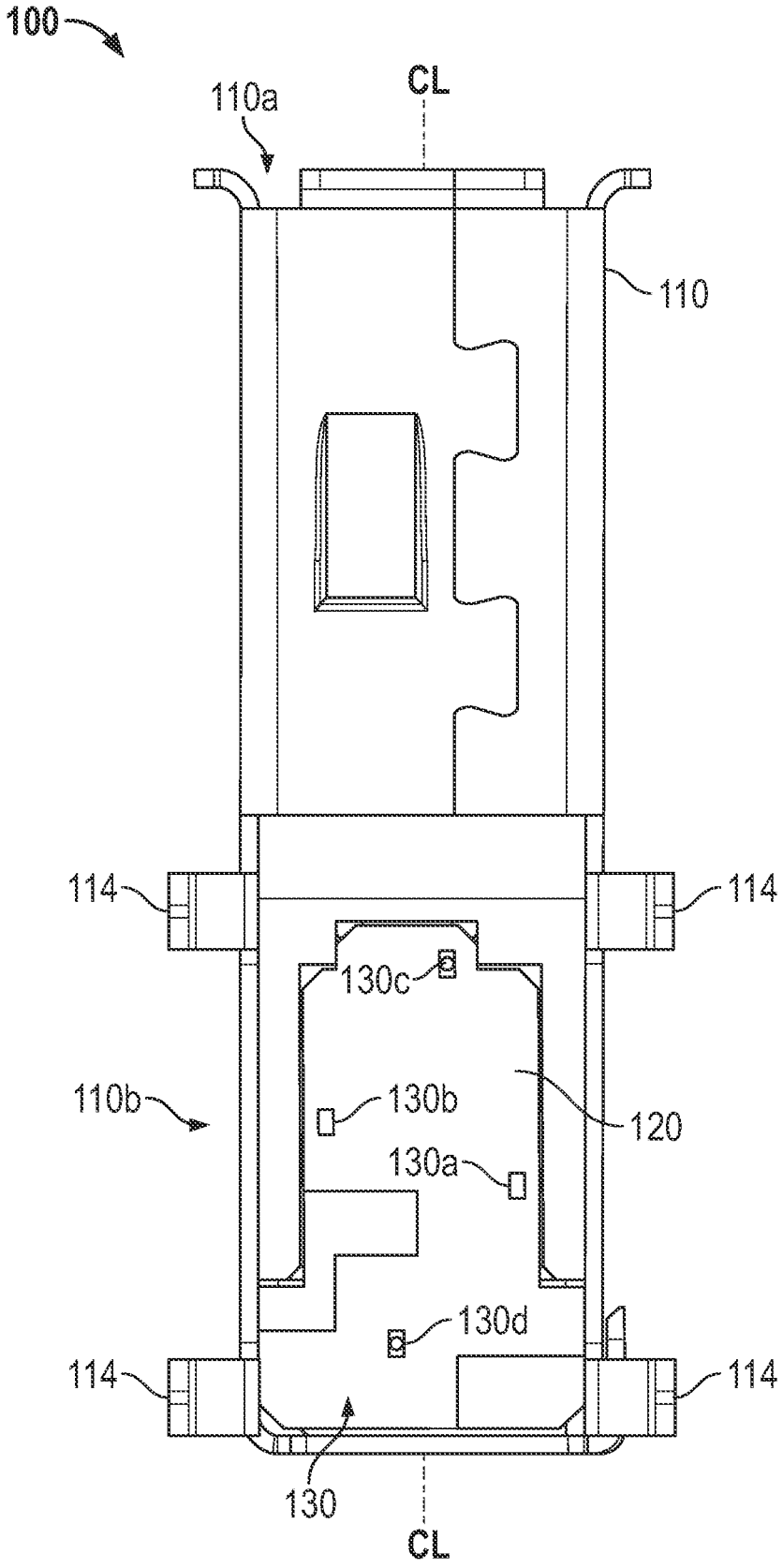
FIG. 10 shows a plan view of the enhanced safety serial bus connector 100.

FIG. 10 shows a plan view of the enhanced safety serial bus connector 100. As shown, the enhanced safety serial bus connector 100 includes the plurality of conductors 130, which is comprised of the first through fourth conductors 130*a*-130*d*. The shell 110 surrounds the insulating body 120. The shell 110 also includes the ground posts 114. As shown in FIG. 10, the second end 110*b* of the shell 110 illustrates the creepage distances between each of the plurality of conductors 130, as well as the creepage distances between each of the plurality of conductors 130 and the ground posts 114. The terminal centerline CL is shown as extending through the center of the enhanced safety serial bus connector 100 at both the first end 110*a* and the second end 110*b*.

As can be seen, the plurality of conductors 130 are uniformly distributed in the insulating body 120 at the second end 110*b*. As a result, the creepage distances between each of the plurality of conductors 130 is substantially the same. The creepage distances being substantially the same can ensure that the minimum spacing is equal to or greater than the minimum enhanced safety distance requirement for the voltage defined by the serial bus standard. However, in alternative embodiments, the creepage distances between each of the plurality of conductors 130 may not be substantially the same, but still meet the minimum enhanced safety distance requirement for the voltage defined by the serial bus standard.

As can also be appreciated, the second end 110*b* also has creepage distances between each of the plurality of conductors 130 and the ground posts 114. For example, the distances between the third conductor 130*c* and the ground posts 114 that are proximate the third conductor 130*c* are about the same. The distances between each of the plurality of conductors 130 and the proximate ground posts 114 can also ensure that the creepage distance is equal to or greater than the minimum enhanced safety distance requirement for the voltage defined by the serial bus standard.

The enhanced safety serial bus connector 100 can be formed by a variety of methods. For example, as shown in FIG. 8, the plurality of conductors 130 may be formed when the assembly strip 136 is, for example, moved through one or more forming tools or any other appropriate device that can form the plurality of conductors 130. Prior to forming the plurality of conductors 130, the assembly strip 136 may be comprised of a blank strip of material. A flat stamped version of the plurality of conductors 130 can be formed by stamping the assembly strip 136 as the assembly strip 136 is, for example, moved through the one or more forming machines. The flat stamped plurality of conductors 130 can be bent into the shape shown in FIG. 8 by, for example, sequentially bending each of the plurality of conductors 130. However, other methods may be employed to form the plurality of conductors 130.

The plurality of conductors 130 can be inserted into an injection molding machine that encapsulates a portion of the plurality of conductors 130. For example, the plurality of conductors 130, which are flat stamped and bent into the shape as shown in FIG. 8, can be encapsulated by the lead portion 124 of the insulating body 120 with an injection molding machine. Accordingly, the plurality of conductors 130 extending from the lead facing surface 124*a* can be uniformly distributed prior to being encapsulated by the shell 110. The insulating body 120 can be sufficiently rigid to ensure that, during subsequent manufacturing processes, the plurality of conductors 130 remain uniformly distributed. For example, when the shell 110 is encapsulated around the insulating body 120, the insulating body 120 can prevent the encapsulation from displacing the plurality of conductors 130.

When the shell 110 is encapsulated over the insulating body 120, the distances between the shell 110 and the plurality of conductors 130 can also be equal to or greater than the minimum enhanced safety distance requirement for the voltage defined by the serial bus standard. For example, the lead facing surface 124*a* of the insulating body 120 can be sized to ensure that the creepage distances between each of the plurality of conductors 130 and the ground posts 114 is equal to or greater than the minimum enhanced safety distance requirement for the voltage defined by the serial bus standard.

The embodiments described above provide an enhanced safety serial bus connector 100. As explained above, the enhanced safety serial bus connector 100 may substantially conform to the serial bus standard. For example, the enhanced safety serial bus connector 100 may include a plurality of conductors 130 where each of the conductors 130*a*-130*d* are spaced apart from an adjacent conductor 130*a*-130*d* with a distance that substantially conforms to spacing requirements of the serial bus standard. As a result, the contacts 132 can transmit data with a USB standard male plug connector at a rate specified by the serial bus standard while still meeting the enhanced safety distance requirement.

The enhanced safety serial bus connector 100 can both substantially conform to the spacing requirements of the serial bus standard and comply with the minimum enhanced safety distance requirement. For example, the plurality of conductors 130 may include contact widths WI, WO that are less than the width specified by the serial bus standard. The plurality of conductors 130 can also be spaced from the terminal centerline CL at distances that are greater than corresponding distances defined in the serial bus standard. Additionally or alternatively, each of the plurality of conductors 130 can also be uniformly distributed in a surface of an insulating body 120. Accordingly, the creepage distance between each of the plurality of conductors 130 may be greater than the minimum enhanced safety distance.

As a result of having the plurality of conductors 130 that are spaced apart with a distance that substantially conforms to the spacing requirements of the serial bus standard, existing manufacturing tools can be used to form the enhanced safety serial bus connector 100. This can reduce the costs of implementing the enhanced safety serial bus connector 100 over a completely new proprietary design. In addition, the enhanced safety serial bus connector 100 is compatible with standard connectors that are in compliance with the serial bus standard. This ensures that existing inventory of cables and connectors can still be used while the enhanced safety serial bus connector 100 complies with the enhanced safety standard. Accordingly, the enhanced safety serial bus connector 100 can be inexpensively designed and incorporated into industrial products that meet the enhanced safety standard.

The detailed descriptions of the above embodiments are not exhaustive descriptions of all embodiments contemplated by the inventors to be within the scope of the present description. Indeed, persons skilled in the art will recognize that certain elements of the above-described embodiments may variously be combined or eliminated to create further embodiments, and such further embodiments fall within the scope and teachings of the present description. It will also be apparent to those of ordinary skill in the art that the above-described embodiments may be combined in whole or in part to create additional embodiments within the scope and teachings of the present description.

Thus, although specific embodiments are described herein for illustrative purposes, various equivalent modifications are possible within the scope of the present description, as those skilled in the relevant art will recognize. The teachings provided herein can be applied to other enhanced safety serial bus connectors, and not just to the embodiments described above and shown in the accompanying figures. Accordingly, the scope of the embodiments described above should be determined from the following claims.

We claim:

1. An enhanced safety serial bus connector (100), comprising:

a shell (110) with a first end (110*a*) and a second end (110*b*);

the first end (110*a*) being a terminal end of the shell (110) and having a terminal centerline (CL); and the second end (110*b*) being the lead end of the shell (110);

an insulating body (120) disposed inside the shell (110) and extending from approximately the first end (110*a*) to the second end (110*b*); and a plurality of conductors (130) substantially disposed in the insulating body (120) and extending from the first end (110*a*) to the second end (110*b*), the plurality of conductors (130) having contacts (132) that:

are proximate the first end (110*a*); and have contact centerlines (X, Y) that are substantially parallel to the terminal centerline (CL);

wherein each conductor (130*a*-130*d*) of the plurality of conductors (130) are spaced apart from an adjacent conductor (130*a*-130*d*) with a distance that:

substantially conforms to spacing requirements of a serial bus standard that defines a voltage on the plurality of conductors (130); and comprises at least one of an increased creepage distance and an increased clearance specified in an enhanced safety standard.

2. The enhanced safety serial bus connector (100) of claim 1, wherein the contact centerlines (X, Y) are spaced from the terminal centerline (CL) at distances that are greater than corresponding distances defined in the serial bus standard.

3. The enhanced safety serial bus connector (100) of one of claim 1 or claim 2, wherein the plurality of conductors (130) are comprised of conductor widths (WI, WO) that are less than widths defined in the serial bus standard.

4. The enhanced safety serial bus connector (100) of one of any of the foregoing claims 1 through 3, wherein the plurality of conductors (130) are comprised of four conductors (130*a*-130*d*), the four conductors (130*a*-130*d*) being comprised of:

two inner conductors (130*a*-130*b*) with inner contact centerlines (X) spaced from the terminal centerline (CL) by approximately 1.15 mm; and two outer conductors (130*c*-130*d*) with outer contact centerlines (Y) spaced from the terminal centerline (CL) by approximately 3.58 mm.

5. The enhanced safety serial bus connector (100) of one of any of the foregoing claims 1 through 4, wherein the plurality of conductors (130) are comprised of four conductors (130*a*-130*d*), the four conductors (130*a*-130*d*) being comprised of:

two inner conductors (130*a*-130*b*) with an inner contact width (WI) of approximately 0.60 mm; and two outer conductors (130*c*-130*d*) with an outer contact width (WO) of approximately 0.85 mm.

6. The enhanced safety serial bus connector (100) of one of any of the foregoing claims 1 through 5, wherein the minimum enhanced safety distance requirement comprises a creepage distance, the creepage distance being a distance along a surface of the insulating body (120).

7. The enhanced safety serial bus connector (100) of one of any of the foregoing claims 1 through 6, wherein the plurality of conductors (130):

are uniformly distributed in a surface of the insulating body (120); and extend from the surface of the insulating body (120) substantially perpendicular to the surface of the insulating body (120).

8. The enhanced safety serial bus connector (100) of claim 7, wherein the surface of the insulating body (120) is a lead facing surface (124*a*) and wherein the plurality of conductors (130) are uniformly distributed in the lead facing surface (124*a*).

9. The enhanced safety serial bus connector (100) of one of any of the foregoing claims 1 through 8, wherein the serial bus standard is a Universal Serial Bus (USB) standard.

10. A method of forming an enhanced safety serial bus connector (100), the method comprising:

forming a shell (110) comprised of a first end (110*a*) and a second end (110*b*):

the first end (110*a*) being a terminal end of the shell (110) and having a terminal centerline (CL); and the second end (110*b*) being the lead end of the shell (110); and forming a plurality of conductors (130) wherein each conductor (130*a*-130*d*) of the plurality of conductors (130) are spaced apart from an adjacent conductor (130*a*-130*d*) with a distance that:

substantially conforms to the spacing requirements of a serial bus standard that defines a voltage on the plurality of conductors (130); and comprises at least one of an increased creepage distance and an increased clearance specified in an enhanced safety standard.

11. The method of forming the enhanced safety serial bus connector (100) of claim 10, the method further comprising:

forming at least a portion of an insulating body (120) about at least a portion of the plurality of conductors (130);

disposing the at least a portion of the insulating body (120) inside the shell (110) and extending from approximately the first end (110*a*) to the second end (110*b*);

positioning the plurality of conductors (130) such that contacts (132):

are proximate the first end (110*a*); and have contact centerlines (X, Y) that are substantially parallel to the terminal centerline (CL).

12. The method of forming the enhanced safety serial bus connector (100) of claim 10 or claim 11, further comprising encapsulating the plurality of conductors (130) with the insulating body (120).

13. The method of forming the enhanced safety serial bus connector (100) of claim 12, wherein the step of encapsulating the plurality of conductors (130) comprises uniformly distributing the plurality of conductors (130) in a surface of the insulating body (120).

14. The method of forming the enhanced safety serial bus connector (100) of claim 12, wherein the step of encapsulating the plurality of conductors (130) comprises extending the plurality of conductors (130) from a surface of the insulating body (120) in a direction that is substantially perpendicular to the surface of the insulating body (120).

15. The method of forming the enhanced safety serial bus connector (100) of one of any of the foregoing claims 10 through 14, wherein the step of forming the plurality of conductors (130) comprises forming a flat version of the plurality of conductors (130) and bending the plurality of conductors (130).

16. The method of forming the enhanced safety serial bus connector (100) of one of any of the foregoing claims 10 through 15, wherein the step of forming the plurality of conductors (130) comprises forming at least one of the plurality of conductors (130) with a width (WI) that is less than the corresponding width specified in the serial bus standard.

17. The method of forming the enhanced safety serial bus connector (100) of one of any of the foregoing claims 10 through 16, wherein the step of forming the plurality of conductors (130) comprises forming at least two of the plurality of conductors (130) having centerlines (X), wherein the distance between the centerlines (X) and the terminal centerline (CL) is greater than the corresponding distance specified in the serial bus standard.

18. The method of forming the enhanced safety serial bus connector (100) of one of any of the foregoing claims 10 through 17, wherein the serial bus standard is a Universal Serial Bus (USB) standard.

* * * * *